US006634730B2

(12) United States Patent
Sugioka

(10) Patent No.: US 6,634,730 B2
(45) Date of Patent: Oct. 21, 2003

(54) INK-JET PRINTHEAD, PRINTING APPARATUS HAVING SAID PRINTHEAD, AND METHOD OF DRIVING SAID PRINTHEAD

(75) Inventor: Hideyuki Sugioka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/818,500

(22) Filed: Mar. 28, 2001

(65) Prior Publication Data

US 2001/0048450 A1 Dec. 6, 2001

(30) Foreign Application Priority Data

Mar. 28, 2000 (JP) ..... 2000-089301

(51) Int. Cl.[7] ..... B41J 29/38; B41J 2/34
(52) U.S. Cl. ..... 347/9; 347/209
(58) Field of Search ..... 347/9, 209, 11, 347/180, 181

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,134,425 A | * | 7/1992 | Yeung | 347/209 |
| 5,235,346 A | * | 8/1993 | Yeung | 347/209 |

FOREIGN PATENT DOCUMENTS

| | | | |
|---|---|---|---|
| EP | 0 532 877 A2 | 3/1993 | B41J/2/16 |
| JP | 54-56847 | 5/1979 | B41J/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |
| JP | 62-201254 | 9/1987 | B41J/3/04 |
| JP | 64-20150 | 1/1989 | B41J/3/04 |
| JP | 64-20151 | 1/1989 | B41J/3/04 |
| JP | 5-185594 | 7/1993 | B41J/3/04 |
| JP | 8-156269 | 6/1996 | B41J/3/04 |

* cited by examiner

*Primary Examiner*—Judy Nguyen
*Assistant Examiner*—Alfred E Dudding
(74) *Attorney, Agent, or Firm*—Fitzpatrick, Cella Harper & Scinto

(57) ABSTRACT

When driving an ink-jet printhead equipped with a matrix-type circuit having a substrate, a plurality of scanning signal lines and a plurality of information signal lines on the substrate and heating elements provided on the substrate at points of intersection between the scanning and information signal lines, scanning signals ($V_{y1}$ to $V_{y3}$) having a first potential ($\frac{1}{2}\cdot V_0$) are supplied sequentially to the scanning signal lines by a first driving circuit, select signals ($V_{x1}$ to $V_{x4}$) having a second potential ($-\frac{1}{2}\cdot V_0$) are supplied to the information signal lines by a second driving circuit in accordance with print data, and each of the scanning and select signals is provided with a first interval (t1) having first and second potentials and with a second interval (t2) over which the potential difference is zero, whereby accumulation of heat at unselected points is prevented to suppress crosstalk.

15 Claims, 8 Drawing Sheets

FIG. 4

| | | | | |
|---|---|---|---|---|
| $Y_1$ | 1 | 1 | 0 | 0 |
| $Y_2$ | 0 | 0 | 1 | 1 |
| $Y_3$ | 1 | 0 | 1 | 0 |
| | $X_1$ | $X_2$ | $X_3$ | $X_4$ |

INK-JET PRINTHEAD, PRINTING APPARATUS HAVING SAID PRINTHEAD, AND METHOD OF DRIVING SAID PRINTHEAD

FIELD OF THE INVENTION

This invention relates to an ink-jet printhead, a printing apparatus having this printhead and a method of driving this printhead. More particularly, the invention relates to an ink-jet printhead used in a printer such as bubble-jet printer that utilizes a bubble forming phenomenon.

BACKGROUND OF THE INVENTION

Printers for printing desired information such as text and images on a sheet-like printing medium such as paper or film are available as the information output devices of word processors, personal computers and facsimile machines, by way of example.

Various techniques are known for application to printing methods employed by printers. Ink-jet technology has become the focus of attention in recent years because of its ability to print on a printing medium such as paper without contacting the medium, the facility with which it lends itself to color printing and the quietness with which printing is performed. A serial printing method is employed most widely as the ink-jet printing method because of the advantages of lower cost and smaller size. The serial printing method employs a mounted printhead for discharging ink in accordance with desired print information. Printing is carried out while the printhead is scanned back and forth at right angles to the direction in which the printing medium such as paper is fed.

One type of ink-jet method is the bubble-jet printing method, which discharges ink droplets by utilizing thermal energy. This method causes the rapid heating and vaporization of ink by a heating element and causes ink droplets to be discharged from nozzles by the pressure of bubbles produced in the ink. Electrical energy or light energy may be used as the energy utilized in heating, and an electrothermal transducer (resistor) for converting electrical energy to thermal energy or a light-to-heat transducer for converting light energy to thermal energy is used as the heating element.

The printhead used in the bubble-jet printing method generally has fine discharge ports (nozzles), liquid passageways and a heating element, which serves as the electrothermal transducer, provided in part of each liquid passageway. In order to improve the definition of an image printed by the ink-jet method, there is need of a technique to discharge very small droplets at as high a density as possible. Arraying the nozzles of the printhead at a high density (adopting high-density multiple nozzles) and finely forming the corresponding passageways and heating elements is of fundamental importance.

In order to realize high-definition printing, there has been proposed a method of manufacturing a high-density printhead that exploits the structural simplification of the bubble-jet printhead and makes free use of photolithography (e.g., see the specification of Japanese Patent Application Laid-Open No. 8-156269). Further, a heating element the produces a greater amount of heat at its center than at its edges has been proposed to adjust the amount of liquid discharged (see the specification of Japanese Patent Application Laid-Open No. 62-201254).

Further, in order to lower mounting cost by reducing the number of wiring patterns when a printhead is provided with the high-density multiple-nozzle configuration, there has been proposed a printhead (referred to as a "matrix-type bubble-jet head"), in which a rectifier element and resistor are serially connected to each intersection point of wiring that is arrayed matrix form, and a liquid is heated and caused to form bubbles by the heating of the resistors, whereby droplets are discharged (e.g., see the specifications of Japanese Patent Application Laid-Open Nos. 64-20150 and 5-185594). Also proposed for the same purpose is a method of placing a rectifier element at each intersection point of a matrix circuit and discharging liquid droplets by causing the heating and bubbling of a liquid due to heat produced by the rectifier elements when a forward current is passed through them (e.g., see the specification of Japanese Patent Application Laid-Open No. 64-20151).

However, the matrix-type bubble-jet head having the heating elements placed at its intersection points is essentially different from a matrix of liquid crystal elements in which electrical crosstalk can be suppressed by reversal of the electric field, and there is the possibility that the discharge of liquid will become uncontrollable owing to crosstalk produced when the printhead is driven. In particular, if heat accumulates at unselected intersection points of the matrix, whether or not liquid is discharged may become uncontrollable owing to a rise in temperature caused by such accumulation of heat.

Further, in the examples of the prior art set forth above, there is a proposal to use rectifier elements (specifically, pn-junction-type diodes) to suppress crosstalk due to field reversal. With an increase in the printing width of multiple nozzles, however, there is the likelihood that manufacturing cost will rise if rectifier elements such as pn-junction-type diodes using semiconductor manufacturing techniques are formed.

SUMMARY OF THE INVENTION

Accordingly, an object of the present invention is to provide an ink-jet printhead, a printing apparatus having this printhead and a method of driving this printhead, in which the occurrence of crosstalk can be suppressed by preventing the accumulation of heat at unselected intersection points in an ink-jet printhead having a matrix circuit.

Another object of the present invention is to provide a matrix-type ink-jet printhead wherein power consumption can be reduced through a simple structure.

An ink-jet printhead according to the present invention for attaining the foregoing and other objects comprises: a substrate; a plurality of scanning signal lines provided on the substrate; a plurality of information signal lines provided on the substrate so as to cross the scanning signal lines; a heating element provided at each point of intersection between the scanning signal lines and information signal lines; a first driving circuit for supplying the scanning signal lines sequentially with a scanning signal having a first potential; and a second driving circuit for supplying the information signal lines with a select signal, which has a second potential, in accordance with print data; wherein ink droplets are discharged utilizing thermal energy produced by the heating elements owing to a potential difference between the first and second potentials; the scanning signal and select signal having first intervals in which a potential difference is produced at the points of intersection by the first and second potentials, and a second interval, in which the potential difference is substantially zero, provided between the first intervals.

The foregoing and other objects are attained by a printing apparatus having the above-described ink-jet printhead for printing on a printing medium by the printhead.

According to the present invention, the foregoing and other objects are attained by providing a method of driving an ink-jet printhead having a substrate; a plurality of scanning signal lines provided on the substrate; a plurality of information signal lines provided on the substrate so as to cross the scanning signal lines; a heating element provided at each point of intersection between the scanning signal lines and information signal lines; a first driving circuit for supplying the scanning signal lines sequentially with a scanning signal having a first potential; and a second driving circuit for supplying the information signal lines with a select signal, which has a second potential, in accordance with print data; wherein ink droplets are discharged utilizing thermal energy produced by the heating elements owing to a potential difference between the first and second potentials; the method comprising providing the scanning signal and select signal with first intervals in which a potential difference is produced at the points of intersection by the first and second potentials, and with a second interval, in which the potential difference is substantially zero, provided between the first intervals.

More specifically, when driving an ink-jet printhead equipped with a matrix-type circuit having a plurality of scanning signal lines on a substrate and a plurality of information signal lines provided on the substrate so as to cross the scanning signal lines; heating elements provided at the points of intersection between the scanning signal lines and information signal lines; a first driving circuit for supplying the scanning signal lines sequentially with a scanning signal having a first potential; and a second driving circuit for supplying the information signal lines with a select signal, which has a second potential, in accordance with print data, wherein ink droplets are discharged utilizing thermal energy produced by the heating elements owing to a potential difference between the first and second potentials, the scanning signal and select signal are provided with first intervals in which a potential difference is produced at the points of intersection by the first and second potentials, and with a second interval, in which the potential difference is substantially zero, provided between the first intervals.

In accordance with the present invention, heat that has accumulated in the vicinity of the heating elements owing to a rise in the temperature thereof is allowed to radiate and dissipate, thereby suppressing the occurrence of crosstalk by preventing the accumulation of heat. As a result, an ink-jet printhead having a structure in which printing elements are integrated at high density can be driven accurately in accordance with print data.

In this case, it is preferred that the second driving circuit supply a non-select signal having a third potential to heating elements that are not allowed to discharge ink droplets, and that a potential difference between the first and third potentials be less than a potential difference necessary to discharge ink droplets.

Further, it is preferred that the second interval have a length which is greater than a length of time necessary for the temperature of heating elements, which has risen owing to the potential difference between the first and third potentials, to substantially return to an initial temperature that prevailed prior to heating.

Further, the second interval may have a length that is greater than a length of time necessary for the temperature of heating elements, which has risen owing to the potential difference between the first and second potentials, to substantially return to an initial temperature that prevailed prior to heating.

If it is so arranged that the absolute values of the first and second potentials are made approximately equal, the two driving circuits for the scanning signal lines and information signal lines can be identically constructed. On the other hand, if it is so arranged that the absolute value of the first potential is made approximately twice the absolute value of the second potential, power consumption at unselected points can be reduced and driving of the signal lines can be performed more stably.

In this case, it is preferred that the polarities of the first and second potentials be the opposite of each other.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a diagram illustrating a pattern of bubble formation based upon the driving voltage waveforms of FIGS. 3A and 3B;

DESCRIPTION OF THE PREFERRED EMBODIMENTS

Preferred embodiments of the present invention will now be described in detail in accordance with the accompanying drawings.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

At first, general structure of an ink jet printer using the printhead according to the present invention will be described.

Apparatus Main Body

Figure 6:
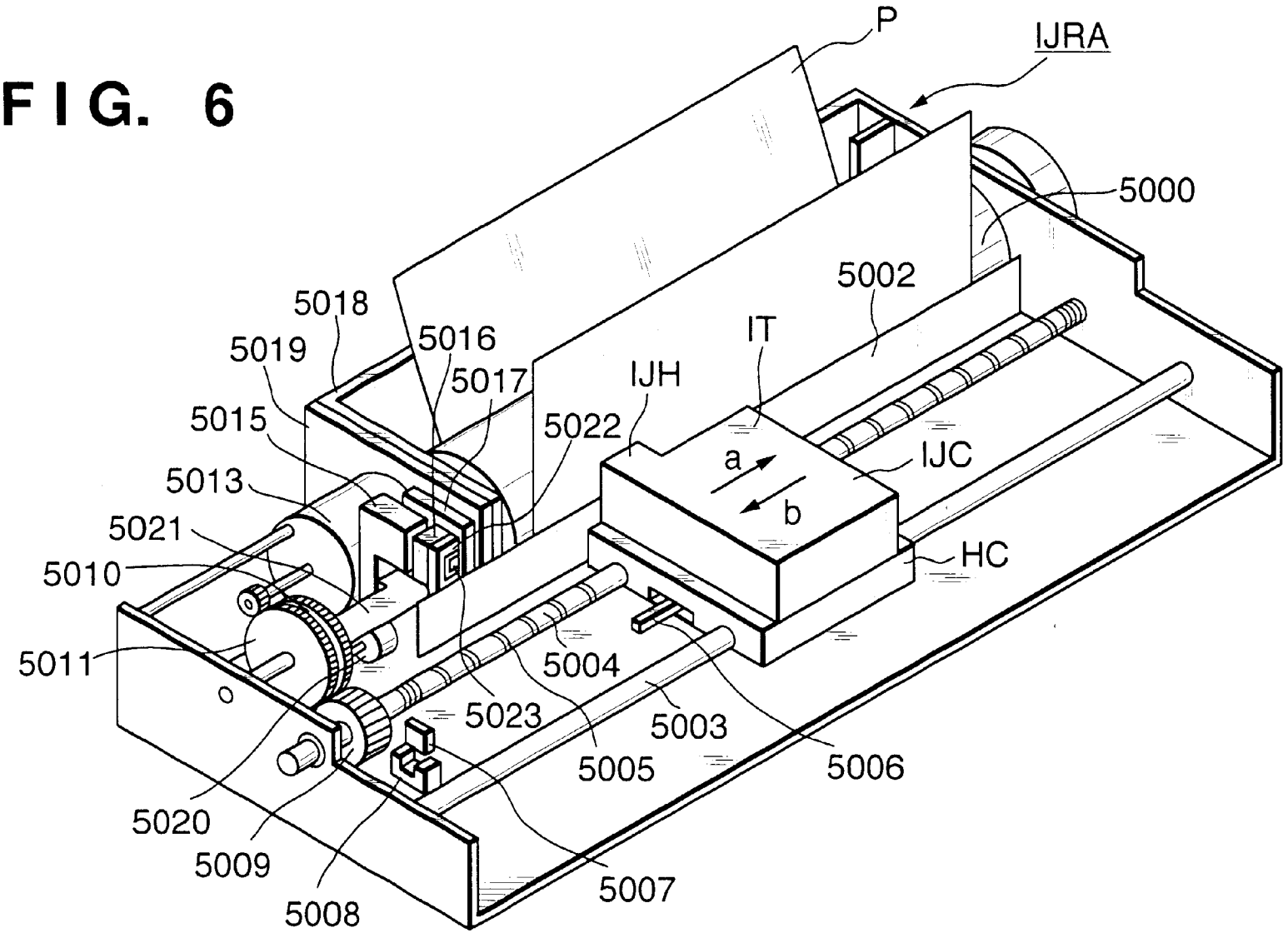
FIG. 6 is a perspective view illustrating the external appearance of a printer in which the ink-jet printhead according to the present invention is used.

FIG. 6 is a perspective view showing an outer appearance of the construction of an ink-jet printer IJRA as a typical embodiment of the present invention. Referring to FIG. 6, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b while being supported by a guide rail 5003. An integrated ink cartridge IJC, incorporating a printhead IJH and an ink tank IT, is mounted on the carriage HC.

In the describe structure, the number of inkjet cartridge IJC mounted on the carriage HC is one, however, when a color printing is performed, a plurality of inkjet cartridges for respective colors of CMYK are mounted on the carriage HC, or an inkjet cartridge IJC is made to have one ink-jet printhead which discharges ink from divided areas for ink supplied from ink tanks IT containing respective ink of colors.

Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and are used for switching, e.g., the rotating direction of the motor 5013.

Reference numeral 5016 denotes a member for supporting a cap member 5022, which caps the front surface of the printhead IJH; and 5015, a suction device for sucking ink residue inside the cap member. The suction device 5015 performs suction recovery of the printhead through an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Control Circuit

Next, description will be provided on the control circuit for executing print control of the above-described printing apparatus.

Figure 7:
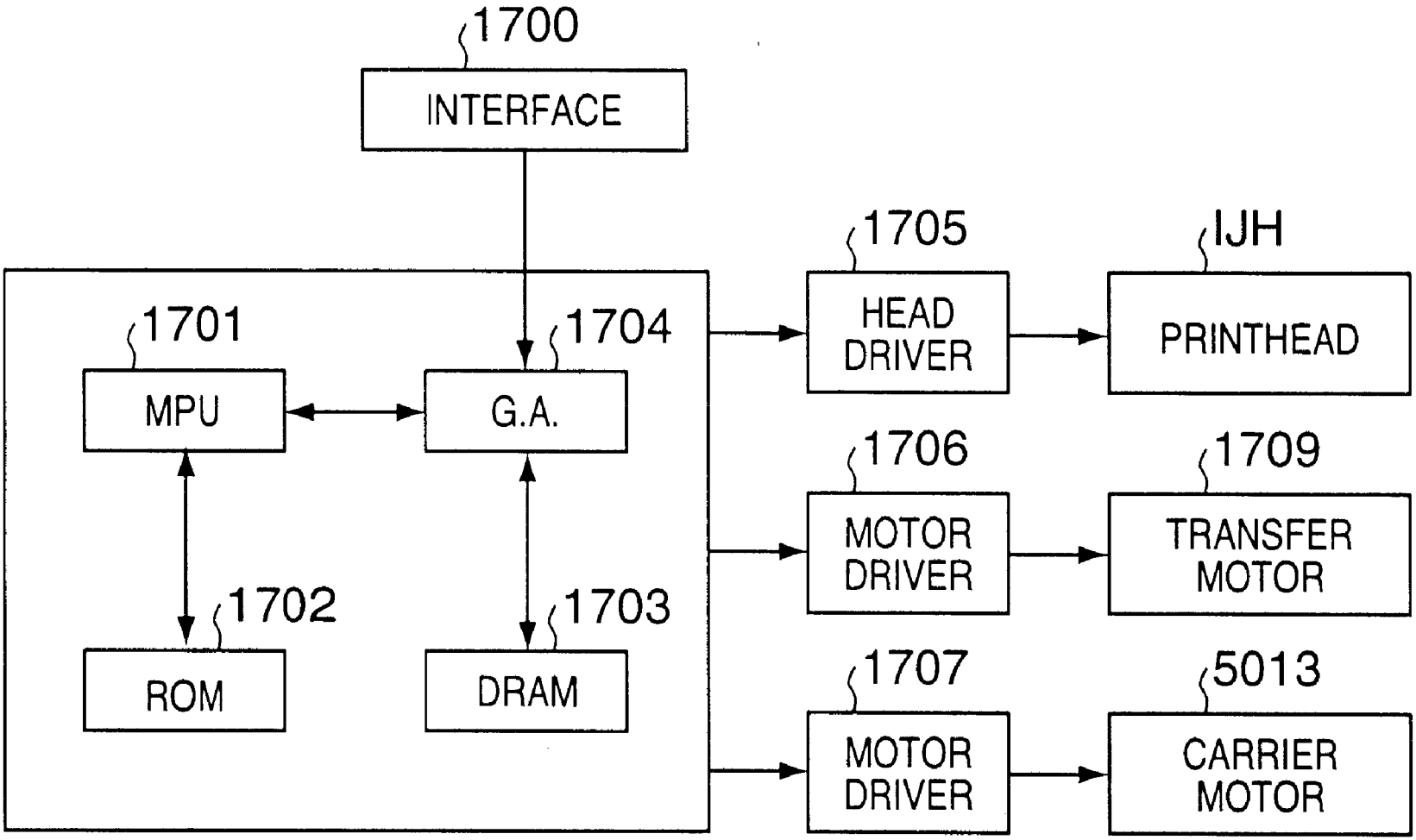
FIG. 7 is a block diagram illustrating the control structure of the printer shown in FIG. 6.

FIG. 7 is a block diagram showing an arrangement of a control circuit of the ink-jet printer IJRA. Referring to FIG. 10 showing the control circuit, reference numeral 1700 denotes an interface for inputting a print signal; 1701, an MPU; 1702, ROM for storing a control program executed by the MPU 1701; and 1703, DRAM for storing various data (aforementioned print signals, or print data supplied to the printhead IJH, and the like). Reference numeral 1704 denotes a gate array (G.A.) for controlling the supply of print data to the printhead IJH. The gate array 1704 also performs data transfer control among the interface 1700, the MPU 1701, and the DRAM 1703. Reference numeral 5013 denotes a carrier motor for conveying the printhead IJH; and 1709, a transfer motor for transferring a print medium. Reference numeral 1705 denotes a head driver for driving the printhead IJH; and 1706 and 1707, motor drivers for driving the transfer motor 1709 and the carrier motor 5013 respectively.

The operation of the aforementioned control structure is now described. When a print signal is inputted to the interface 1700, the print signal is converted to print data by the gate array 1704 and MPU 1701 intercommunicating with each other. As the motor drivers 1706 and 1707 are driven, the printhead IJH is driven in accordance with the print data transferred to the head driver 1705, thereby performing printing.

In this case, the control program executed by the MPU 1701 is stored in the ROM 1702, it is also possible to add an erasable/writable storage medium such as an EEPROM, and to change the control program stored therein from the host computer connected to the ink-jet printer IJRA.

Ink Cartridge

Note that the ink tank IT and printhead IJH may be integrally structured to constitute the exchangeable ink cartridge IJC as described above, or may be configured separably so as to allow exchange of only the ink tank IT when ink is exhausted.

Figure 8:
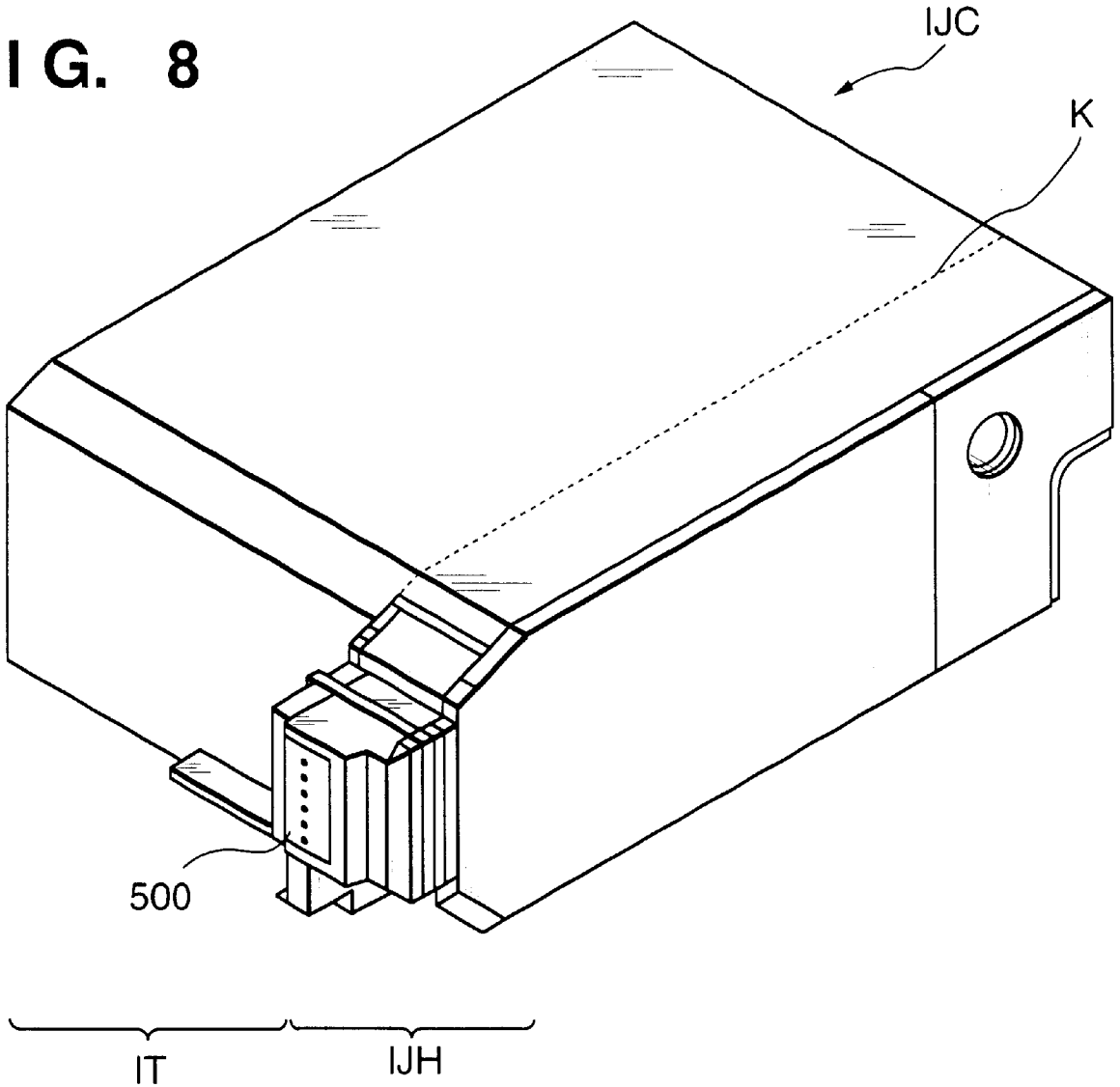
FIG. 8 is a diagram illustrating an ink-jet cartridge used in the printer of FIG. 6.

FIG. 8 is a perspective view showing an outer appearance of the ink cartridge IJC where the printhead IJH and ink tank IT are separable. In the ink cartridge IJC shown in FIG. 11, the printhead IJH can be separated from the ink tank IT at the boundary line K. The ink cartridge IJC includes an electrical contact portion (not shown) so that the ink cartridge IJC receives electrical signals from the carriage HC when mounted on the carriage HC. The printhead IJH is driven by the received electrical signals as described before.

Note in FIG. 8, reference numeral 500 denotes an array of ink discharge orifices. The ink tank IT includes a fibrous or porous ink absorbing member for maintaining ink.

Embodiments of an ink-jet printhead according to the present invention applied to the above-mentioned printer will now described.

First Embodiment

Figure 1:
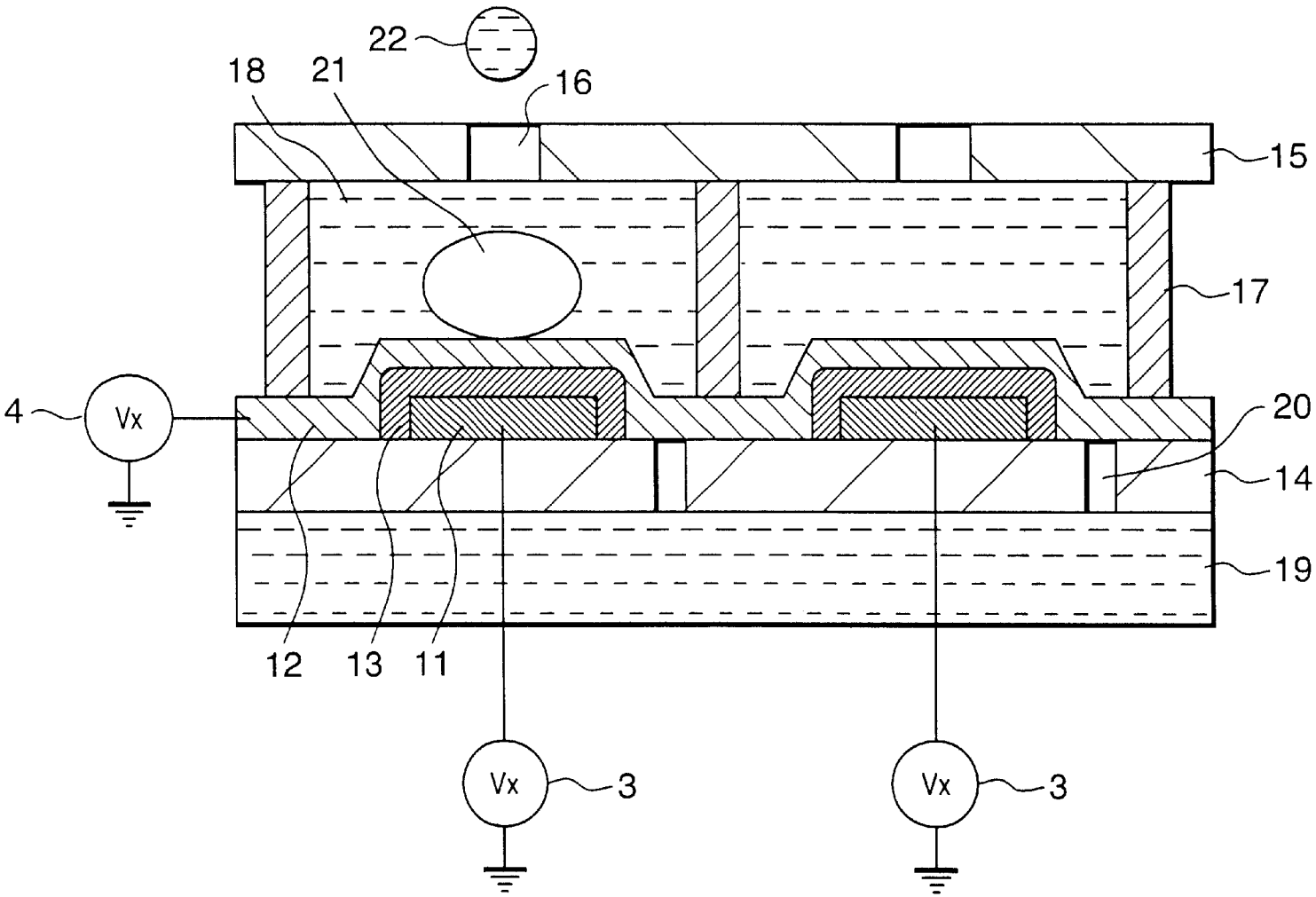
FIG. 1 is a sectional view illustrating the structure of a first embodiment of an ink-jet printhead according to the present invention.

FIG. 1 is a sectional view illustrating the multilayer structure of a first embodiment of an ink-jet printhead according to the present invention. As shown in FIG. 1, the printhead includes an information electrode 11 extending in a direction perpendicular to the plane of printing paper, and a scanning electrode 12 which is perpendicular to the information electrode 11. A matrix circuit is constructed by arraying a plurality of the information electrodes 11 and a plurality of the scanning electrodes 12 in such a manner that the electrodes 11 and 12 intersect each other at right angles.

A heating element 13 is placed at each intersection point of the matrix circuit. A resistor heating element, a non-linear element (MIM, varistor or diode, etc.) or a combined heating element obtained by serially connecting a resistor heating element and a non-linear element may be used as the heating element. Here a thin-film heating element sandwiched between the thin film of the information electrode 11 and the thin film of the scanning electrode 12 constructing the matrix circuit is used.

The thin film 13 constituting the heating element may be a homogeneous thin film such as a conductor thin film, insulator thin film or semiconductor thin film, or a heterogeneous thin film such as a ceramic thin film or glass thin film. The thin-film heating element 13 sandwiched between the thin films of the information and scanning electrodes possesses a linear or non-linear current-voltage characteristic. If an insulator thin film is used as the thin film 13, it is preferred that the film thickness be such that a Pool-Frenkel current will flow through it or, more preferably, that the film thickness be such that a tunnel current will flow through it.

The printhead further includes a substrate 14 on which the matrix electrodes are formed, an upper substrate 15 having discharge holes (nozzles) 16, a wall 17 and a liquid chamber 18 filled with a discharge liquid (ink) when bubbles are not being produced. The printhead further includes an ink chamber 19 and an ink supply port 20. Numeral 21 denotes an air bubble produced by local heating of the ink, and 22 an ink droplet discharged by pressure from the nozzle 16 by pressure from the air bubble 21.

Driving circuits 3 and 4 apply electric potentials to the information electrode 11 and scanning electrode 12, respectively. The driving circuit 3 has a voltage source $V_x$ for applying potential to the information electrode 11, and the driving circuit 4 has a voltage source $V_y$ for applying potential to the scanning electrode 12. The heating element 13 is driven by voltage waveforms described later.

Figure 2:
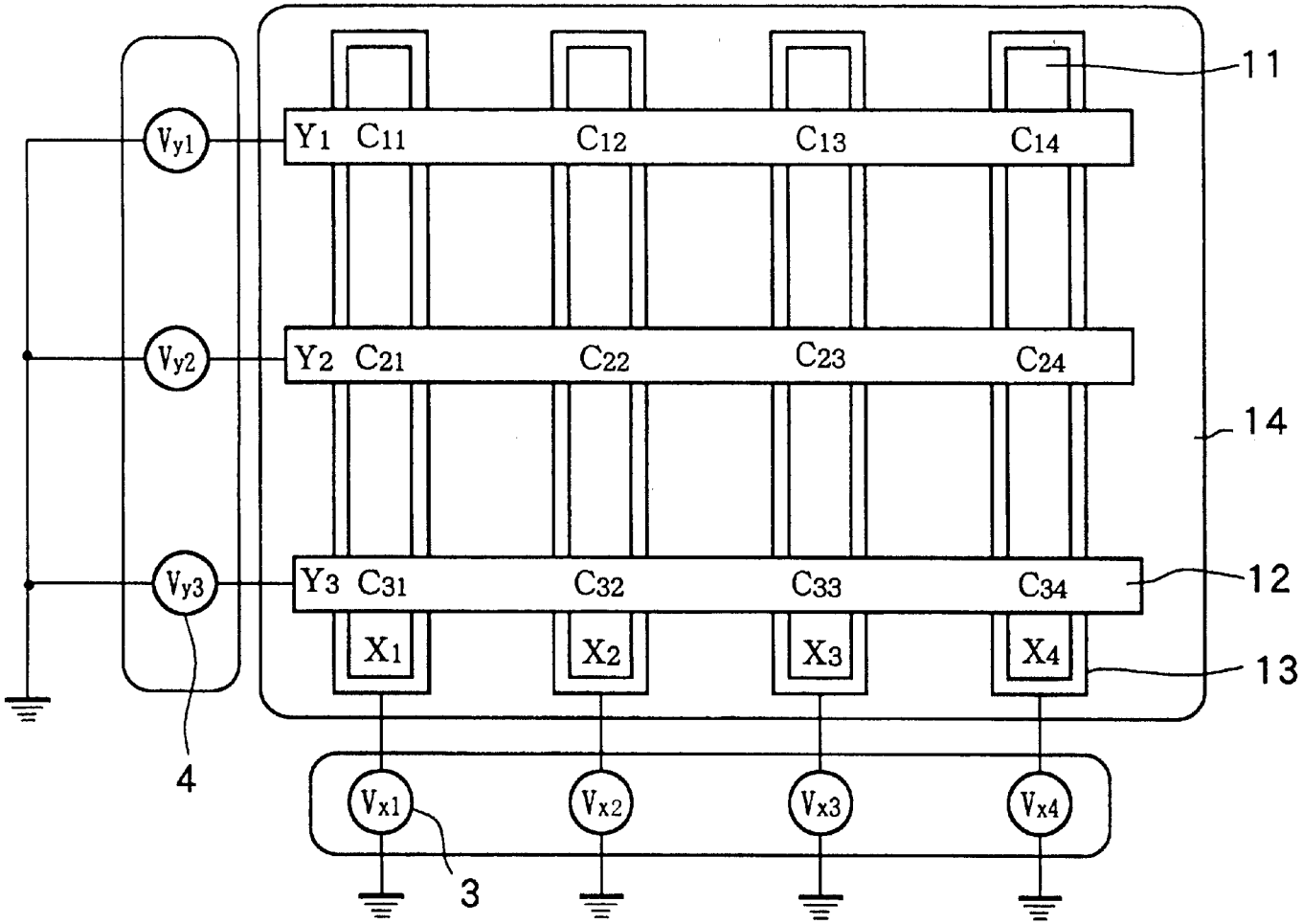
FIG. 2 is a top view showing a matrix circuit according to the first embodiment.

FIG. 2 is a diagram schematically illustrating this embodiment as seen from above. In this illustrated example, the matrix electrodes are four information electrodes $X_1$, $X_2$, $X_3$, $X_4$ and three scanning electrodes $Y_1$, $Y_2$, $Y_3$. Voltages sources $V_{y1}$, $V_{y2}$, $V_{y3}$ on the scanning side apply electric potential to respective ones of the scanning electrodes, and voltages sources $V_{x1}$, $V_{x2}$, $V_{x3}$, $V_{x4}$ on the information side apply electric potential to respective ones of the information electrodes.

Heating positions at the points of intersection of the matrix electrodes are indicated at $C_{11}, C_{12}, \ldots, C_{34}$. Though it appears in FIG. 2 that the thin-film heating element 13 surrounds the information electrode 11, the information electrode 11 is actually coated with the thin-film heating element 13 in the manner shown in FIG. 1.

Figure 3A:
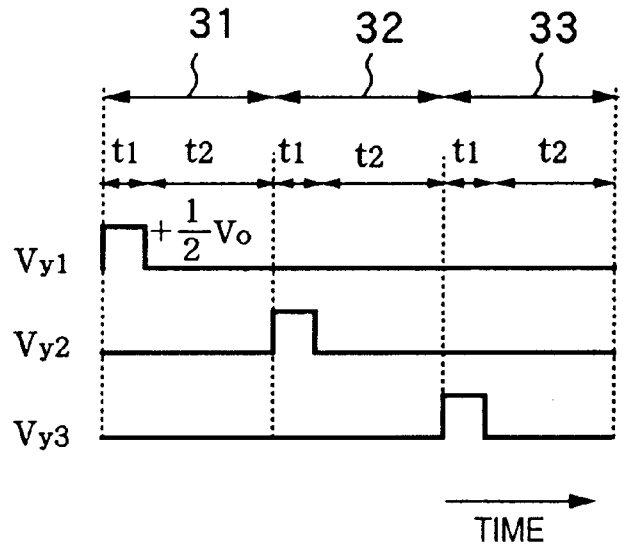
FIGS. 3A to 3C are timing charts illustrating driving voltage waveforms of the first embodiment.
Figure 3B:
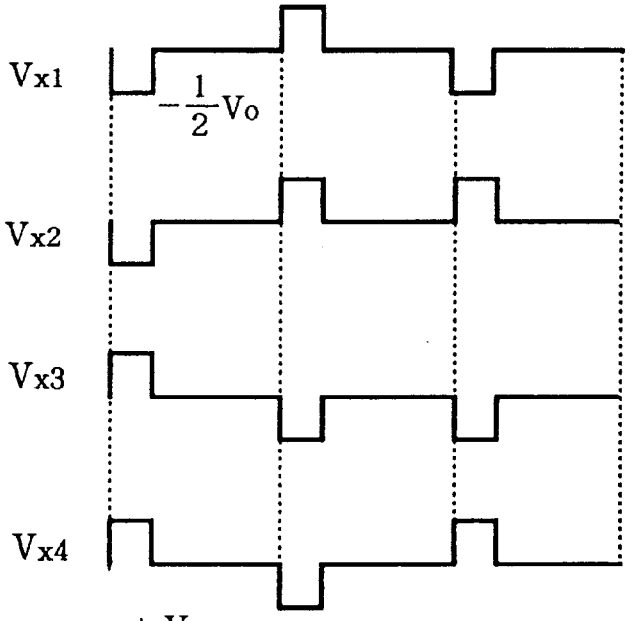
Figure 3C:
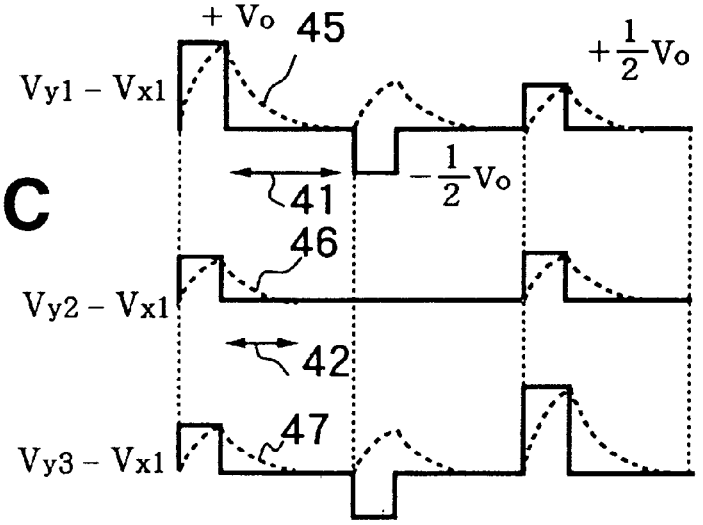

FIGS. 3A to 3C are timing charts illustrating an example of driving waveforms according to this embodiment, in which FIG. 3A shows voltage waveforms impressed upon the scanning electrodes $Y_1$, $Y_2$, $Y_3$, FIG. 3B voltage waveform impressed upon the information electrodes $X_1$, $X_2$, $X_3$, $X_4$, and FIG. 3C potential differences impressed upon intersections $C_{11}$, $C_{21}$, $C_{31}$ of the matrix.

As shown in FIG. 3A, a driving voltage of $\frac{1}{2}\cdot V_0$ is supplied to the scanning electrodes $Y_1$, $Y_2$, $Y_3$ in turns. In a line select time period 31, the points of intersection $C_{11}$, $C_{12}$, $C_{13}$, $C_{14}$ of the heating elements 13 on the scanning electrode $Y_1$ are heated in accordance with the potential differences between the driving voltage and the voltages impressed upon respective ones of the information electrodes. Similarly, in a line select time period 32, the points of intersection $C_{21}$, $C_{22}$, $C_{23}$, $C_{24}$ of the heating elements 13 on the scanning electrode $Y_2$ are heated in accordance with the potential differences between the driving voltage and the voltages impressed upon respective ones of the information electrodes.

Meanwhile, as shown in FIG. 3B, select and non-select voltages are impressed upon the information electrodes $X_1$, $X_2$, $X_3$, $X_4$ in accordance with print data that has been transmitted to the printhead. In this embodiment, the select voltage is $-\frac{1}{2}\cdot V_0$ and the non-select voltage is $\frac{1}{2}\cdot V_0$.

In accordance with the voltage waveforms shown in FIGS. 3A and 3B, therefore, a potential difference of $V_0$ is produced in the first line select time period 31 at the portions situated at the intersections $C_{11}$ and $C_{12}$ of heating elements 13, in the second line select time period 32 at the portions situated at the intersections $C_{23}$ and $C_{24}$ of heating elements 13, and in a third line select time period 33 at the portions situated at the intersections $C_{31}$ and $C_{33}$ of heating elements 13. The heating elements at these intersection points are heated and cause the formation of bubbles in the ink, whereby ink droplets are discharged.

FIG. 4 is a diagram illustrating a pattern according to which the intersection points of the matrix electrodes are driven by the driving waveforms of FIGS. 3A and 3B. A "1" in FIG. 4 indicates an intersection point at which a bubble is produced to discharge an ink droplet, and a "0" indicates an intersection point at which no bubble is produced.

FIG. 3C illustrates the potential differences produced at the intersection points $C_{11}$, $C_{21}$, $C_{31}$ by the waveforms shown in FIGS. 3A and 3B. The dotted lines indicated at 45, 46 and 47 in FIG. 3C indicate the temperature profiles of the intersection points $C_{11}$, $C_{21}$, $C_{31}$, respectively. A time period 42 is that required for the temperature in the vicinity of an unselected heating element to substantially return to the initial temperature that prevailed prior to heating, and a time period 41 is that required for the temperature in the vicinity of a selected heating element to substantially return to the initial temperature that prevailed prior to heating.

In this embodiment, the voltage waveforms applied to the scanning electrodes and information electrodes have a first interval t1 in which voltage is applied and a second interval t2 in which almost no voltage is applied. The intervals t1 and t2 reside in each of the line select time periods 31, 32 and 33. The duration of the second interval t2 is set to be longer than the time period 42 and, most preferably, longer than the time period 41. By thus setting the duration, heat that has accumulated in the vicinity of the heating elements 13 is radiated and allowed to dissipate. The occurrence of crosstalk, therefore, is suppressed by preventing heat from accumulating at unselected points.

Especially, in the case that the above heating element is formed on a thin-film heat accumulating layer having the film thickness of d and the thermal diffusion coefficient of a provided on a thermal conductor, the effect at unselected time is suppressed, if the second interval t2 is set to;

$$0.25\cdot d^2/4a<t2<4.0\cdot d^2/4a.$$

The above condition of the second interval t2 is the condition where a thermal conducting distance $L=2(a\cdot t2)^{1/2}$ is set as $0.5d<L<2.0d$. In this expression, $L=0.5d$ is the condition for defining the lower limit of time where the temperature rise due to the heat generated at the heating element and conducted through the heat accumulating layer is began to suppress, and $L=2.0d$ is the condition for defining the upper limit of time where the temperature rise due to the heat generated at the heating element and conducted through the heat accumulating layer is almost finished.

Preferably, the thermal conductor is a substrate of Si or Al, and the thin-film heat accumulating layer is formed of $SiO_2$ or SiN.

As a concrete example, for a resistor heating element formed on a thin-film heat accumulating layer of $SiO_2$ provided on a substrate of Si having the thickness of d=2.75 μm and the thermal diffusion coefficient of $a=0.85\cdot10^{-6}$ $m^2/s$, in order to improve the crosstalk characteristic, the second interval t2 should be set to;

$$0.555\ \mu s<t2<8.38\ \mu s.$$

Further, in the case that the heating element is a non-linear element, heating value due to leakage current is regarded to be lower than 1/100 of the heating value required to the discharge, therefore, it is sufficient that the second interval t2 is set to satisfy the condition of the thickness of the heat accumulating layer d being nearly equal to the heat conducting distance L.

That is, in the case that the heating element has a non-linear current-voltage characteristic, and formed on a thin-film heat accumulating layer having the film thickness of d and the thermal diffusion coefficient of a provided on a thermal conductor, the temperature rise at the unselected period is suppressed, if the second interval t2 is set to;

$$0.25\cdot d^2/4a<t2<1.0\cdot d^2/4a.$$

In the case that the heating element has a heat accumulating layer, it is preferable that the first interval t1 is set between d and $2(a\cdot t1)^{1/2}$ for temperature rise at the bubble formation and subsequent heat radiation.

Thus, as stated above, the heating element is a non-linear element, and formed on a thin-film heat accumulating layer having the film thickness of d and the thermal diffusion coefficient of a, it is preferable for a design of a driver circuit, that the first interval t1 is set to be equal to the second interval t2 and satisfy the following condition of;

$$0.25\cdot d^2/4a<t2(=t1)<1.0\cdot d^2/4a.$$

According to the voltage waveforms shown in FIGS. 3A to 3C, the design is such that the absolute value of the voltage peak ($\frac{1}{2}\cdot V_0$.) applied to the scanning electrodes and the absolute value of the voltage peak ($\frac{1}{2}\cdot V_0$ or $-\frac{1}{2}\cdot V_0$) applied to the information electrodes are substantially equal. This is an ideal arrangement in that the two driving circuits for driving the scanning and information electrodes can be identically constructed.

In this case the value of $V_0$ is set in such a manner that the bubble-formation threshold value, which is the potential difference at which bubbling occurs, will fall between (preferably approximately midway between) the potential difference ($V_0$) produced at an intersection point at which an ink droplet is to be discharged and the potential difference ($\frac{1}{2}\cdot V_0$) produced at an intersection point at which an ink droplet is not to be produced.

Second Embodiment

A second embodiment of an ink-jet printhead according to the present invention will now be described. This embodiment has a construction substantially the same as that of the first embodiment but the voltage waveforms applied to the scanning and information electrodes differ from those of the first embodiment. The aspects that differ will now be described.

Figure 5A:
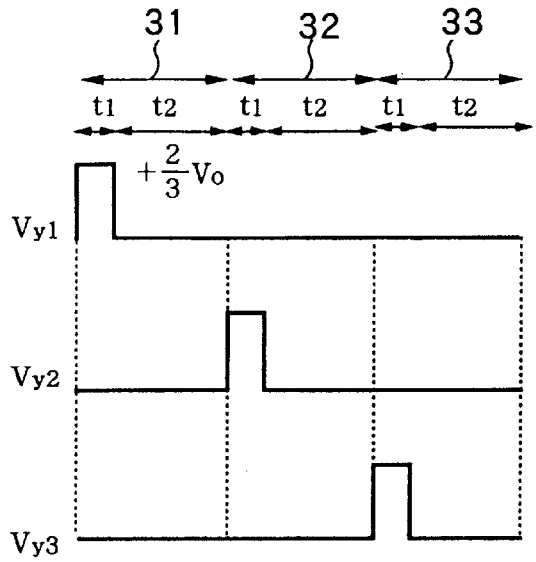
FIGS. 5A to 5C are timing charts illustrating driving voltage waveforms according to a second embodiment.
Figure 5B:
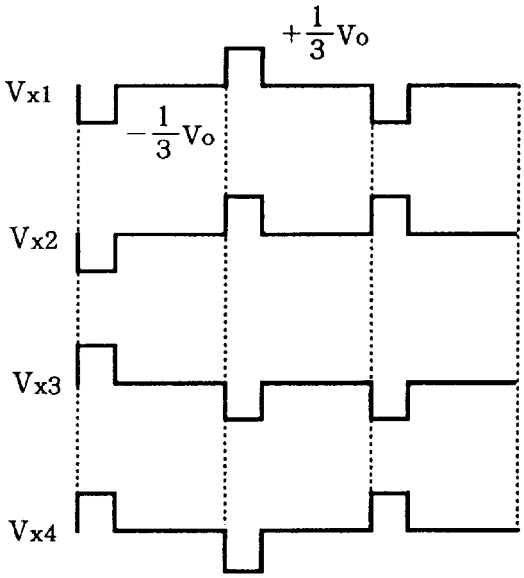
Figure 5C:
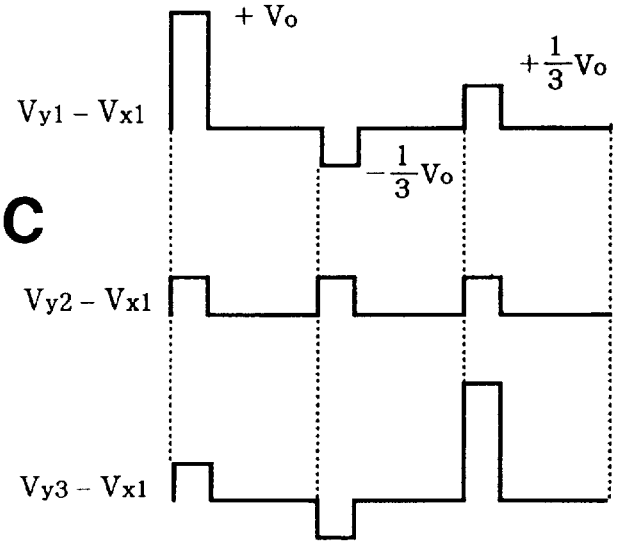

FIGS. 5A to 5C are timing charts in which voltage waveforms applied to the scanning and information electrodes of the second embodiment are illustrated in a manner similar to that of FIGS. 3A to 3C.

As shown in FIGS. 5A to 5C, this embodiment is such that the absolute value of a voltage peak ($\frac{2}{3}\cdot V_0$) applied to the scanning electrodes and the absolute value of a voltage peak ($\frac{1}{3}\cdot V_0$ or $-\frac{1}{3}\cdot V_0$) applied to the information electrodes are set to a ratio of 2:1. In other words, the peak value of voltage applied to the scanning electrodes is approximately twice that applied to the information electrodes.

If this arrangement is adopted, the voltage impressed upon the information electrodes can be made comparatively small at all times in each of the line select time periods 31 to 33. As a result, the energy for driving the information electrodes can be reduced and, as a result, so can power consumption.

Other Embodiments

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. An ink-jet printhead comprising:

a substrate;

a plurality of scanning signal lines provided on said substrate;

a plurality of information signal lines provided on said substrate so as to cross said scanning signal lines;

a heating element provided at each point of intersection between said scanning signal lines and said information signal lines;

a first driving circuit for supplying said scanning signal lines sequentially with scanning signals having a first potential within a predetermined driving period; and a second driving circuit for supplying said information signal lines with select signals, which have a second potential, in accordance with print data, selectively within the predetermined driving period, wherein ink droplets are discharged utilizing thermal energy produced by said heating elements owing to a potential difference between the first and second potentials, and said first and second driving circuits provide the scanning signals and the select signals respectively with intervals, within the predetermined driving period, in which the potentials of both the scanning signals and the select signals are zero.

2. The ink-jet printhead according to claim 1, wherein absolute values of the first and second potentials are approximately equal.

3. The ink-jet printhead according to claim 1, wherein the absolute value of the first potential is approximately twice the absolute value of the second potential.

4. The ink-jet printhead according to claim 1, wherein polarities of the first and second potentials are opposite of each other.

5. The ink-jet printhead according to claim 1, wherein each of the intervals has a length which is greater than a length of time necessary for a temperature of the heating elements, which has risen owing to the potential difference between the first and second potentials, to substantially return to an initial temperature that prevailed prior to heating.

6. The ink-jet printhead according to claim 1, wherein said second driving circuit supplies non-select signals having a third potential to those of said heating elements that are not to discharge the ink droplets, and a potential difference between the first and third potentials is smaller than a potential difference necessary to discharge the ink droplets.

7. The ink-jet printhead according to claim 6, wherein each of the intervals has a length which is greater than a length of time necessary for a temperature of said heating elements, which has risen owing to the potential difference between the first and third potentials, to substantially return to an initial temperature that prevailed prior to heating.

8. A printing apparatus for printing on a printing medium by a printhead, said printhead comprising:

a substrate;

a plurality of scanning signal lines provided on said substrate;

a plurality of information signal lines provided on said substrate so as to cross said scanning signal lines;

a heating element provided at each point of intersection between said scanning signal lines and said information signal lines;

a first driving circuit for supplying said scanning signal lines sequentially with scanning signals having a first potential within a predetermined driving period; and a second driving circuit for supplying said information signal lines with select signals, which have a second potential, in accordance with print data, selectively within the predetermined driving period, wherein ink droplets are discharged utilizing thermal energy produced by said heating elements owing to a potential difference between the first and second potentials, and said first and second driving circuits provide the scanning signals and the select signals respectively with intervals, within the predetermined driving period, in which the potentials of both the scanning signals and the select signals are zero.

9. A method of driving an ink-jet printhead having a substrate, a plurality of scanning signal lines provided on the substrate, a plurality of information signal lines provided on the substrate so as to cross the scanning signal lines, a heating element provided at each point of intersection between the scanning signal lines and information signal lines, a first driving circuit for supplying the scanning signal lines sequentially with scanning signals having a first potential within a predetermined driving period, and a second driving circuit for supplying the information signal lines with select signals, which have a second potential, in accordance with print data, selectively within the predetermined driving period, wherein ink droplets are discharged utilizing thermal energy produced by the heating elements owing to a potential difference between the first and second potentials, said method comprising:

a step of providing the scanning signals and the select signals with intervals, within the predetermined driving period, in which the potentials of both the scanning signals and the select signal are zero.

10. The method according to claim 9, further comprising a step of making absolute values of the first and second potentials approximately equal.

11. The method according to claim 9, further comprising a step of making the absolute value of the first potential approximately twice the absolute value of the second potential.

12. The method according to claim 9, further comprising making polarities of the first and second potentials opposite of each other.

13. The method according to claim 9, further comprising setting a length of each of the intervals to be greater than a length of time necessary for a temperature of the heating elements, which has risen owing to the potential difference between the first and second potentials, to substantially return to an initial temperature that prevailed prior to heating.

14. The method according to claim 9, further comprising a step of supplying non-select signals having a third potential to those of the heating elements that are not to discharge the ink droplets, and a step of making a potential difference between the first and third potentials smaller than a potential difference necessary to discharge the ink droplets.

15. The method according to claim 14, further comprising a step of setting a length of each of the intervals to be greater than a length of time necessary for a temperature of the heating elements, which has risen owing to the potential difference between the first and third potentials, to substantially return to an initial temperature that prevailed prior to heating.

* * * * *